US007201450B1

(12) United States Patent
Chen

(10) Patent No.: US 7,201,450 B1
(45) Date of Patent: Apr. 10, 2007

(54) ADJUSTABLE ARM RESTING DEVICE FOR CHAIR

(76) Inventor: Su-Ming Chen, No. 566, Fong Lin 2nd Rd., Ta Liao Hsiang, Kaohsiung (TW)

( * ) Notice: Subject to any disclaimer, the term of this patent is extended or adjusted under 35 U.S.C. 154(b) by 0 days.

(21) Appl. No.: 11/461,452

(22) Filed: Aug. 1, 2006

(51) Int. Cl.
*A47C 7/54* (2006.01)

(52) U.S. Cl. ..... 297/411.37; 297/411.35

(58) Field of Classification Search ..... 297/411.37, 297/411.35
See application file for complete search history.

(56) References Cited

U.S. PATENT DOCUMENTS 6,908,158 B2 * 6/2005 Willette et al. ..... 297/411.37
6,948,775 B2 * 9/2005 Tsai ..... 297/411.37
6,957,866 B1 * 10/2005 Cai ..... 297/411.35

* cited by examiner

*Primary Examiner*—Milton Nelson, Jr.
(74) *Attorney, Agent, or Firm*—Leong C. Lei

(57) ABSTRACT

An arm resting device contains a resting element, an adjustment element, a track element, and a connection element. The adjustment element contains a first piece and a second piece. The track element has an elongated through slot and the connection element has a trough with two sectorial portions. The track element is fixedly attached to the resting element while the adjustment element is fixedly attached to the connection element. The advancement of the arm resting device is achieved by the relative sliding movement between the first piece of the adjustment element and the track element. The orientation of the arm resting device is adjusted by turning the second piece of the adjustment element within the confinement of the trough of the connection element.

6 Claims, 7 Drawing Sheets

ADJUSTABLE ARM RESTING DEVICE FOR CHAIR

BACKGROUND OF THE INVENTION (a) Technical Field of the Invention

The present invention generally relates to a chair's armrests, and more particularly to armrests whose lateral position and orientation are adjustable.

(b) Description of the Prior Art

For seating comfort, there are various types of chairs whose backrests and seats can be raised and lowered to fit the particular posture of a user. One such chair is illustrated in FIG. 1. As depicted, the seat 11 is fixedly mounted perpendicularly to an end of a threaded shaft 13 whose other end is screwed into a base 14 of the chair 1. When the seat 11 is spun relative to the base 14, the seat 11 can be raised or lowered. On the other hand, a backrest 15 of the chair 1 has a jacket 17 at the back wrapping around an elongated plug 18 at an end of a flexible belt extended from the bottom of the seat 11. The backrest 15 can be slid along the plug 18 so as to reach an appropriate height. Then, a twisting knob 16 is used to tightly clip the jacket 17 and the plug 18 together.

As shown in FIG. 1, the chair 1 has a pair of arm resting devices 12 fixedly attached to two lateral sides of the seat 11 respectively. The arm resting devices 12 are therefore raised or lowered together with the seat 11. FIG. 2 shows another conventional arm resting device 2 which can be raised or lowered independently. As illustrated, the arm resting device 2 contains a resting element 21 having a flat and extended top portion for supporting a user's arm and a bottom portion for receiving a plug 221 at an end of an L-shaped leg 22 whose other end is attached to the seat (not shown). The resting element 21 can be slid along the plug 221 so as to reach an appropriate height. Then, a twisting knob 23 is used to tightly and fixedly join the resting element 21 and the plug 221 together at the particular height.

Even though the arm resting device 2 described above can be raised or lowered individually and independently, it cannot be adjustably shifted towards the front or the back of the chair, or turned to the left or the right of the chair so as to provide improved seating comfort.

SUMMARY OF THE INVENTION

The primary purpose of the present invention is to provide an arm resting device, which can be shifted to the front or back, or turned to the left or right of the chair. The arm resting device contains at least a resting element, an adjustment element, a track element, and a connection element. The adjustment element contains a first piece and a second piece. The track element has an elongated through slot and the connection element has a trough with two sectorial portions so that the first and second pieces of the adjustment element are housed inside the slot and the trough respectively. The track element is fixedly attached to the resting element while the adjustment element is fixedly attached to the connection element.

The advancement of the arm resting device to the front or back is achieved by the relative sliding movement between the first piece of the adjustment element and the track element. The orientation of the arm resting device is adjusted by turning the second piece of the adjustment element within the confinement of the trough of the connection element.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
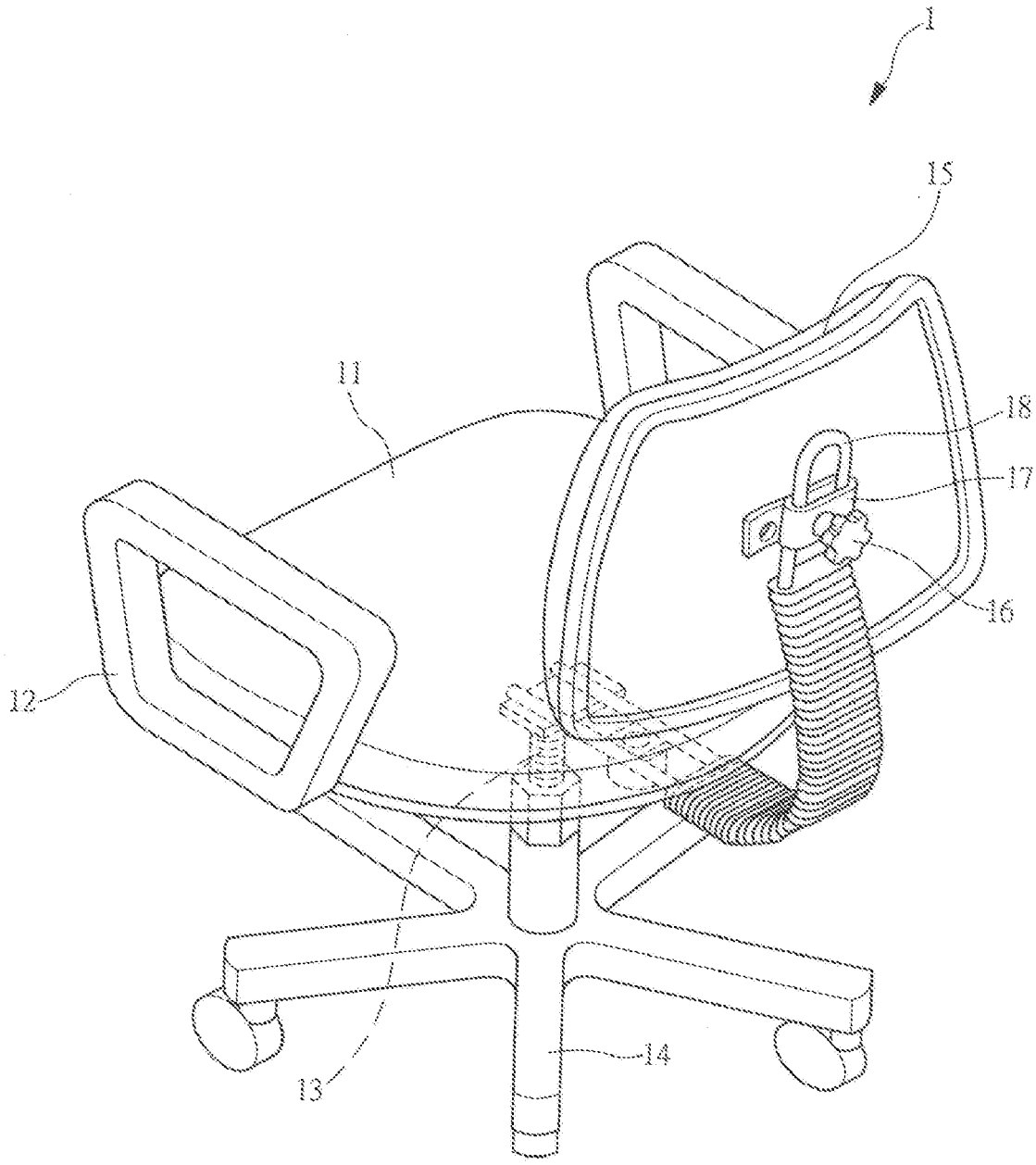
FIG. 1 PRIOR ART
FIG. 1 is a perspective view showing a conventional chair.
Figure 2:
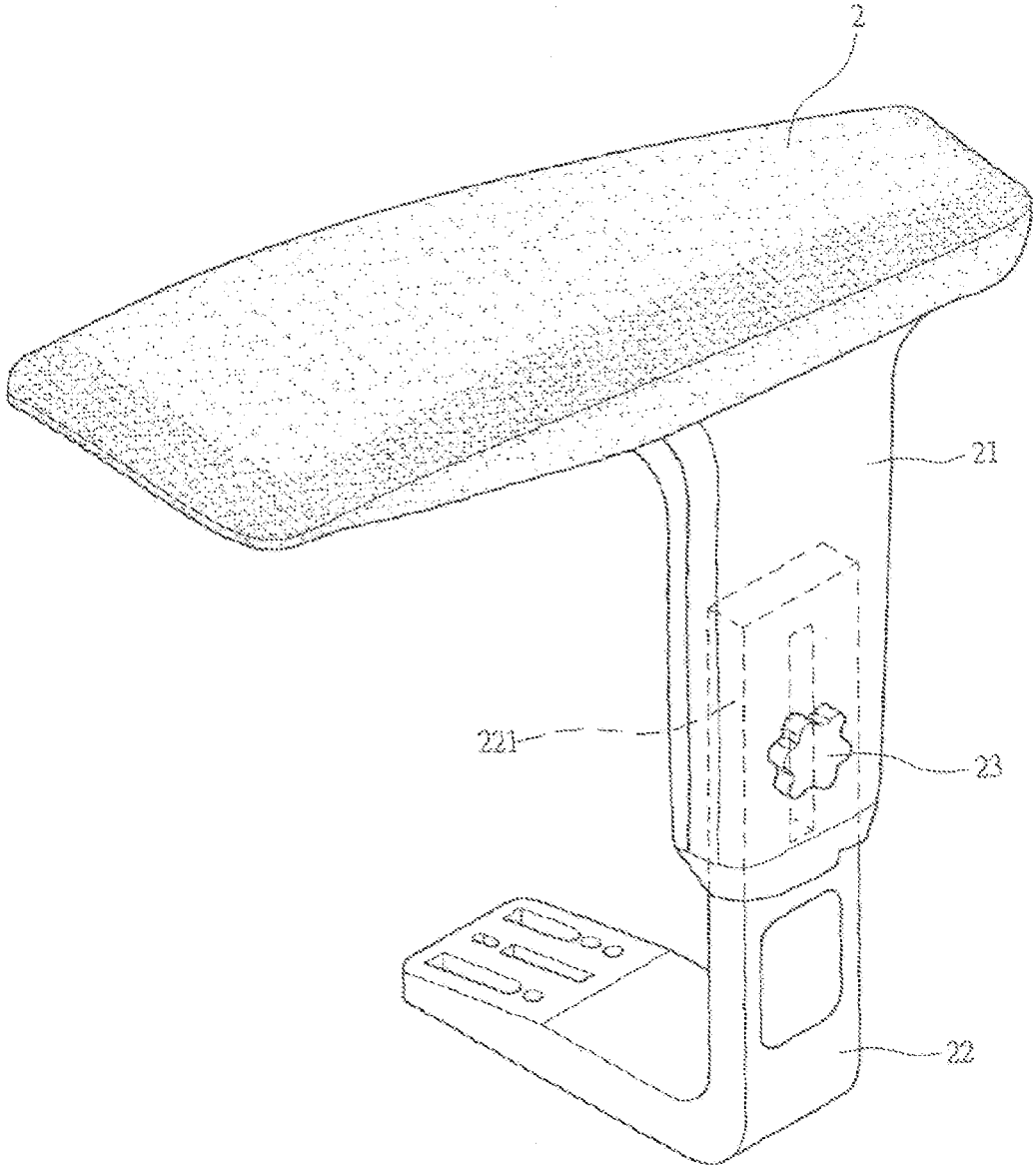
FIG. 2 PRIOR ART
FIG. 2 is a perspective view showing a conventional arm resting device.
Figure 3:
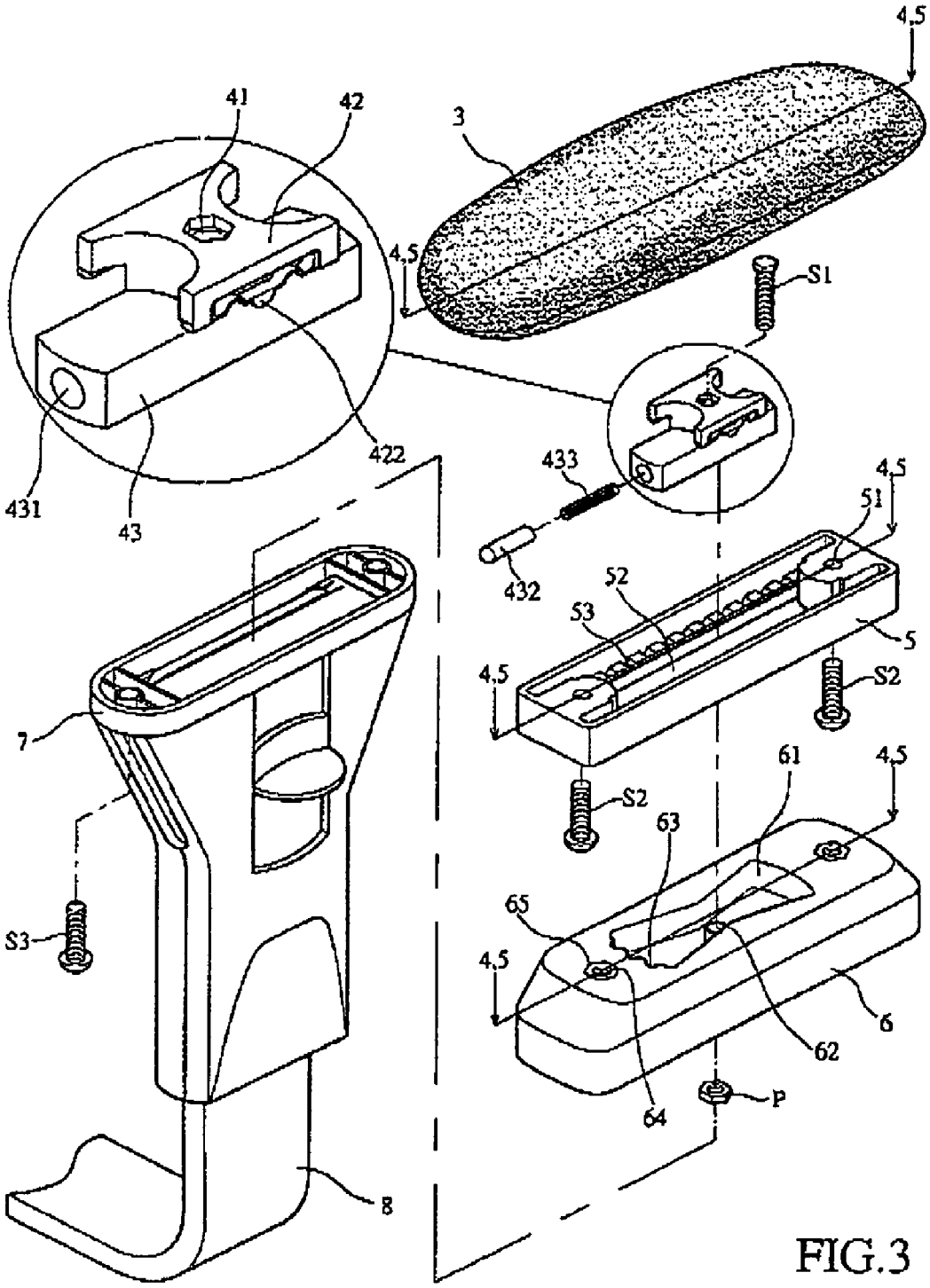
FIG. 3 is a perspective exploded view showing the various components of an arm resting device according to an embodiment of the present invention.

As shown in FIG. 3, the arm resting device according to an embodiment of the present invention is mounted on a support base 7, which contains a resting element 3, an adjustment element 4, a track element 5, and a connection element 6.

The resting element 3 contains flexible and soft material to provide a substantially flat top surface for the resting of a user's arm.

The adjustment element 4 has a first piece 42, a second piece 43 positioned beneath a bottom surface of the first piece 42, and a through hole 41 running through the first and second pieces 42 and 43 in a vertical direction. Two indentations 421 are provided on the bottom surface along two opposing sides of the first piece 42 respectively. Within each indentation 421, a rod 422 having a rounded end protruding downward is provided. The rod 422 has a certain degree of flexibility due to provision of the indentation 421. The second piece 43 has a rectangular body with a blind hole 431 running along the length of the body whose opening is on a narrow side of the body. A resilient piece 433 and a stick 432 are placed inside the hole 431. The first and second pieces 42 and 43 are positioned so that the length of the second piece 43 runs parallel to the two sides of the first piece 42 where the indentations 421 are located.

The track element 5 has a rectangular body with a through slot 52 running along the length of the body, two through holes 51 next to the two ends of the slot 52, a number of consecutive curved notches 53 running along the length of the body at the two sides of the slot 52 respectively. The slot 52 is provided such that the second piece 43 of the adjustment element 4 can penetrate through while the first piece 42 can be supported above and slid along the slot 52. As such, the rounded rods 422 will be trapped in two curved notches 53 respectively, thereby positioning the adjustment element 4 at a particular location along the track element 5.

The connection element 6 also has a rectangular body with a trough 61 on a top surface. The trough 61 contains two sectorial portions fanned out towards the two narrow ends of the connection element 6. At the center of trough 61, a tube 62 is provided. Along the arc of one of the sectorial portions, a number of curved notches 63 are provided. The trough 61 is provided such that the second piece 43 of the adjustment element 4 can be accommodated and turned within the confinement of the sectorial portions with the tube 62 as the pivotal point. The stick 432, protruded by the resilient piece 433, will be trapped by one of the curved notches 63. Two blind holes 64 are provided on the top surface between the trough 61 and the two narrow ends of the connection element 6 respectively. A nut 65 is pre-configured inside each hole 64.

The support base 7 is fixedly mounted on a leg 8 to a side of the seat of the chair (both not shown). Two through holes are provided at two ends of an elongated top portion of the support base 7.

Figure 4:
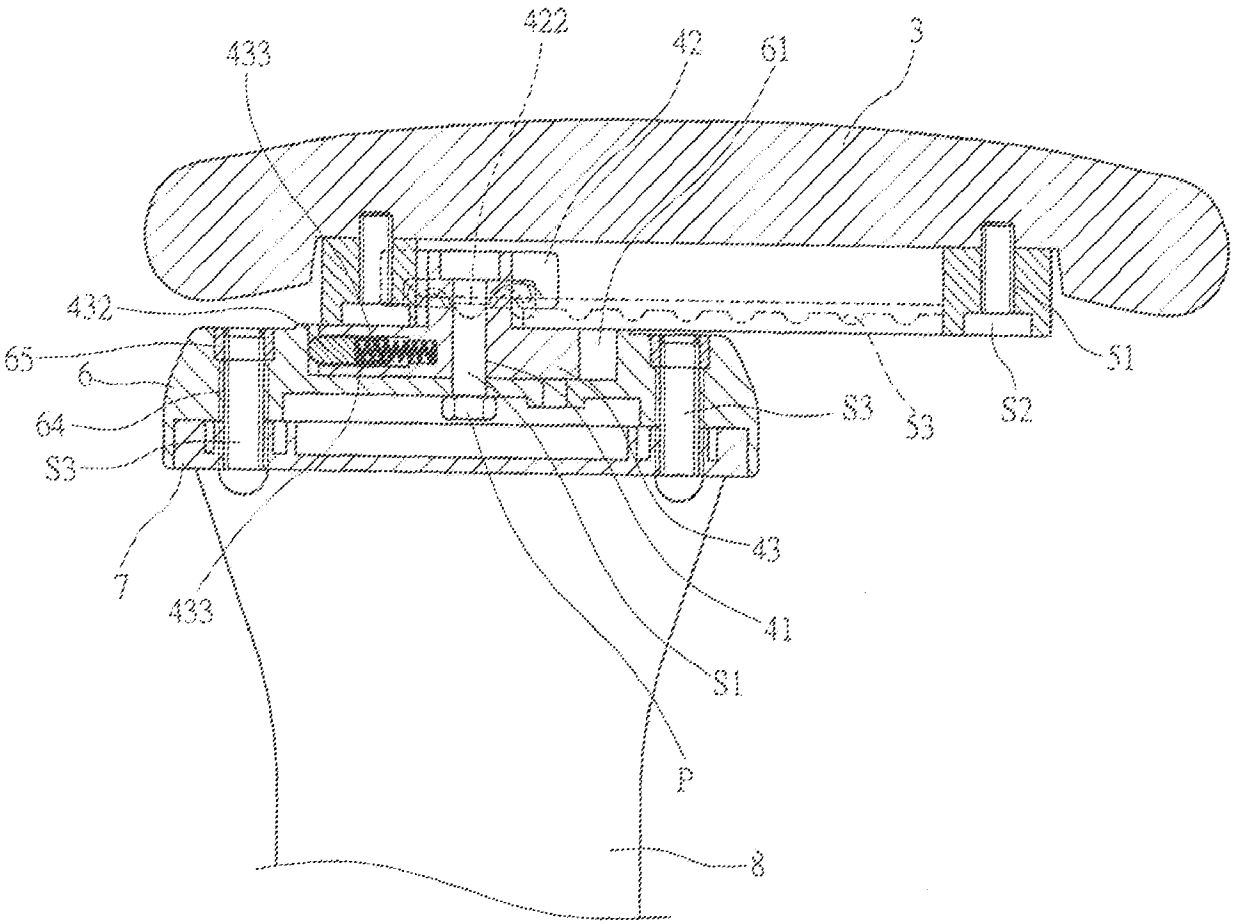
FIG. 4 is a sectional view showing the arm resting device of FIG. 3.
Figure 6:
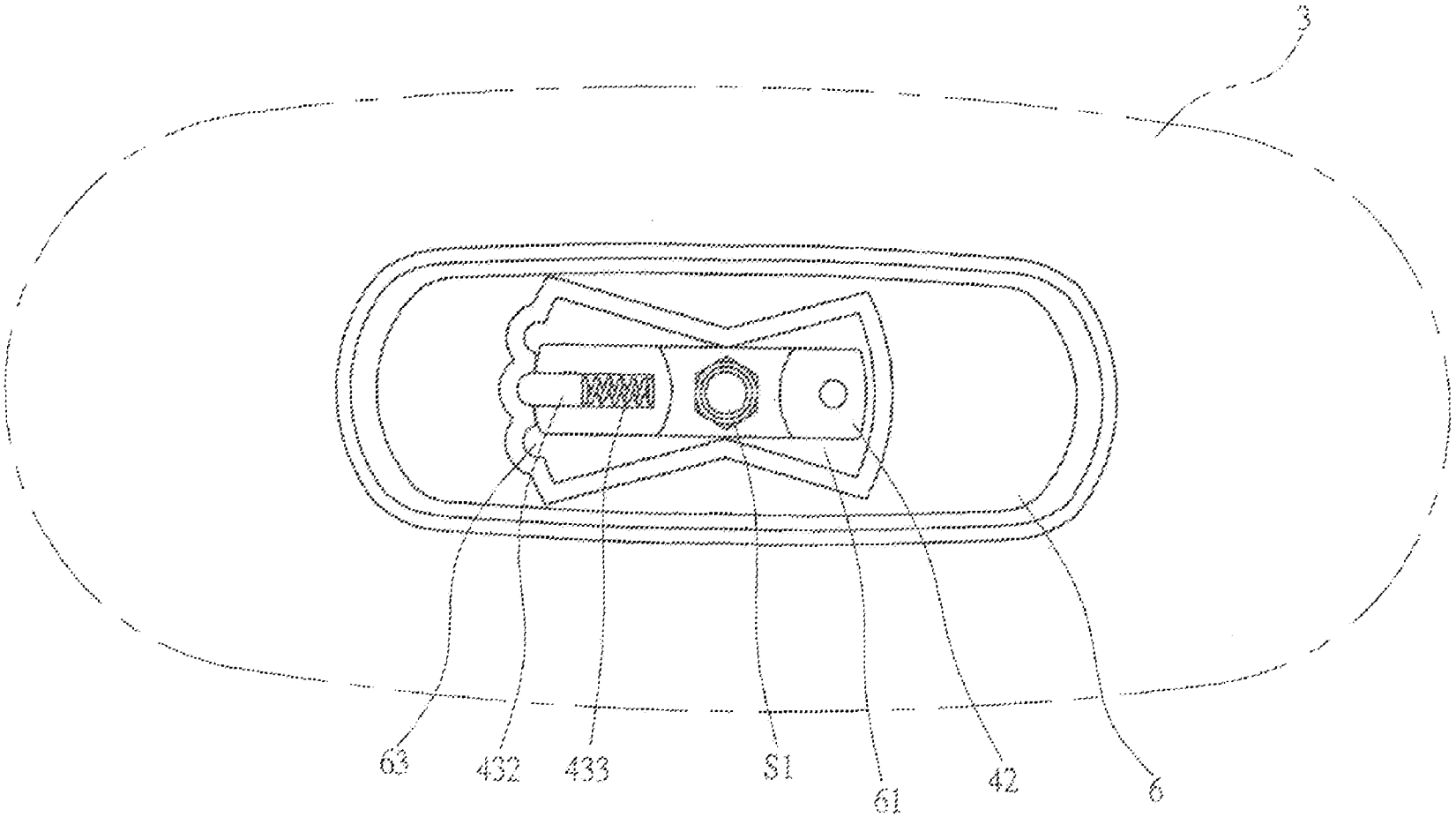
FIG. 6 is a top view showing the arm resting device of FIG. 3.

To assemble the arm resting device described above, The adjustment element 4 is first positioned inside the slot 52 of the track element 5 so that the protruding rods 422 of the first piece 42 are inside two corresponding curved notches 53 of the track element 5. Then, a bolt S1 is run through the through hole 41 and two bolts S2 screw the track element 5 (including the adjustment element 4) to the bottom of the resting element 3. The resilient piece 433 and the stick 432 are then inserted in this sequence into the hole 431 of the second piece 43 of the adjustment 4. Subsequently, the second piece 43 is housed inside the trough 61 of the connection element 6 with the stick 432 inside a curved notch 63. At this point, the bolt S1 will run through the tube 62 and a nut P is used to join the connection element 6 to the bottom of the track element 5, and thereby the resting element 3. The resulting assembly is finally positioned on the top portion of the support base 7 and two bolts S3 are run through the through holes of the support base and the through holes 64 of the connection element 6 from the bottom up and fastened by the pre-configured nuts 65. The completed assembly of the arm resting device is shown in FIGS. 4 and 6.

Figure 5:
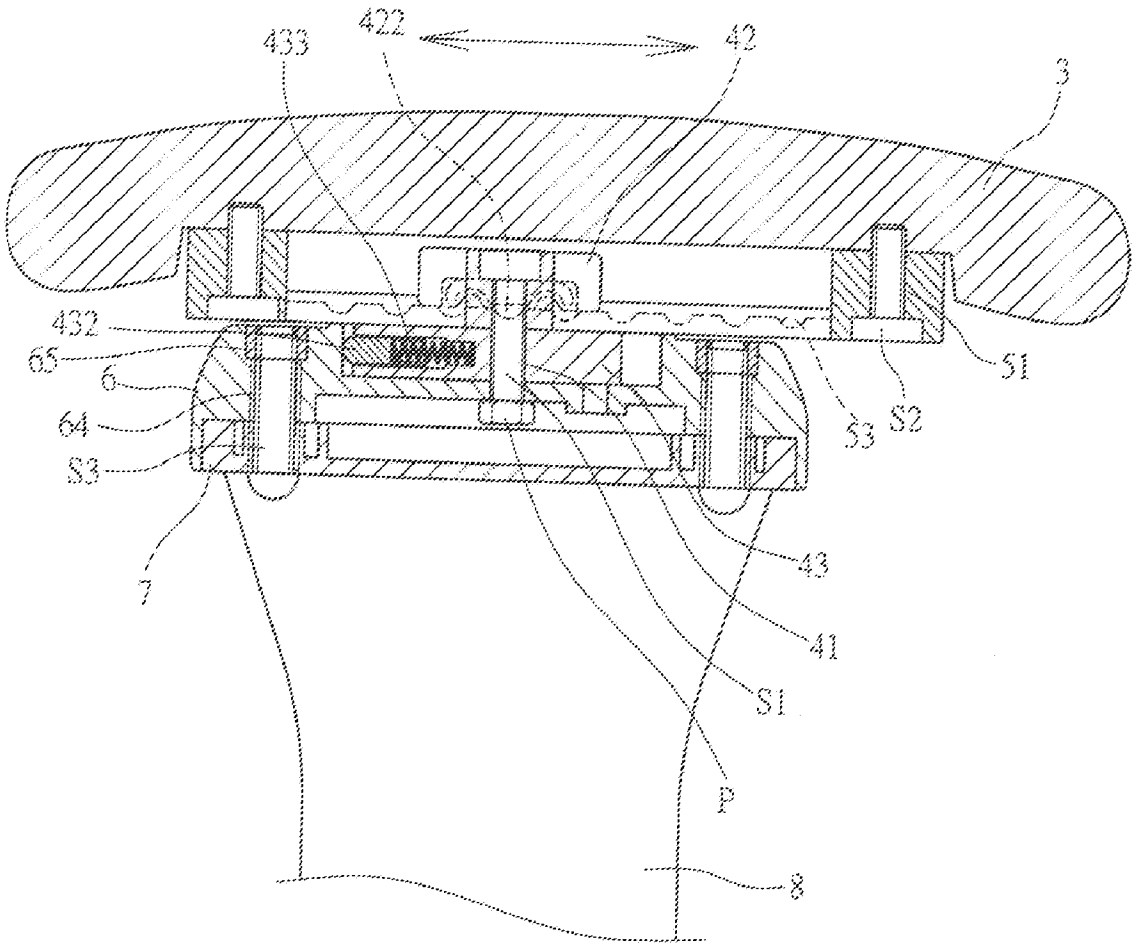
FIG. 5 is a sectional view showing the arm resting device of FIG. 3 shifted to a different location from the location of FIG. 4.
Figure 7:
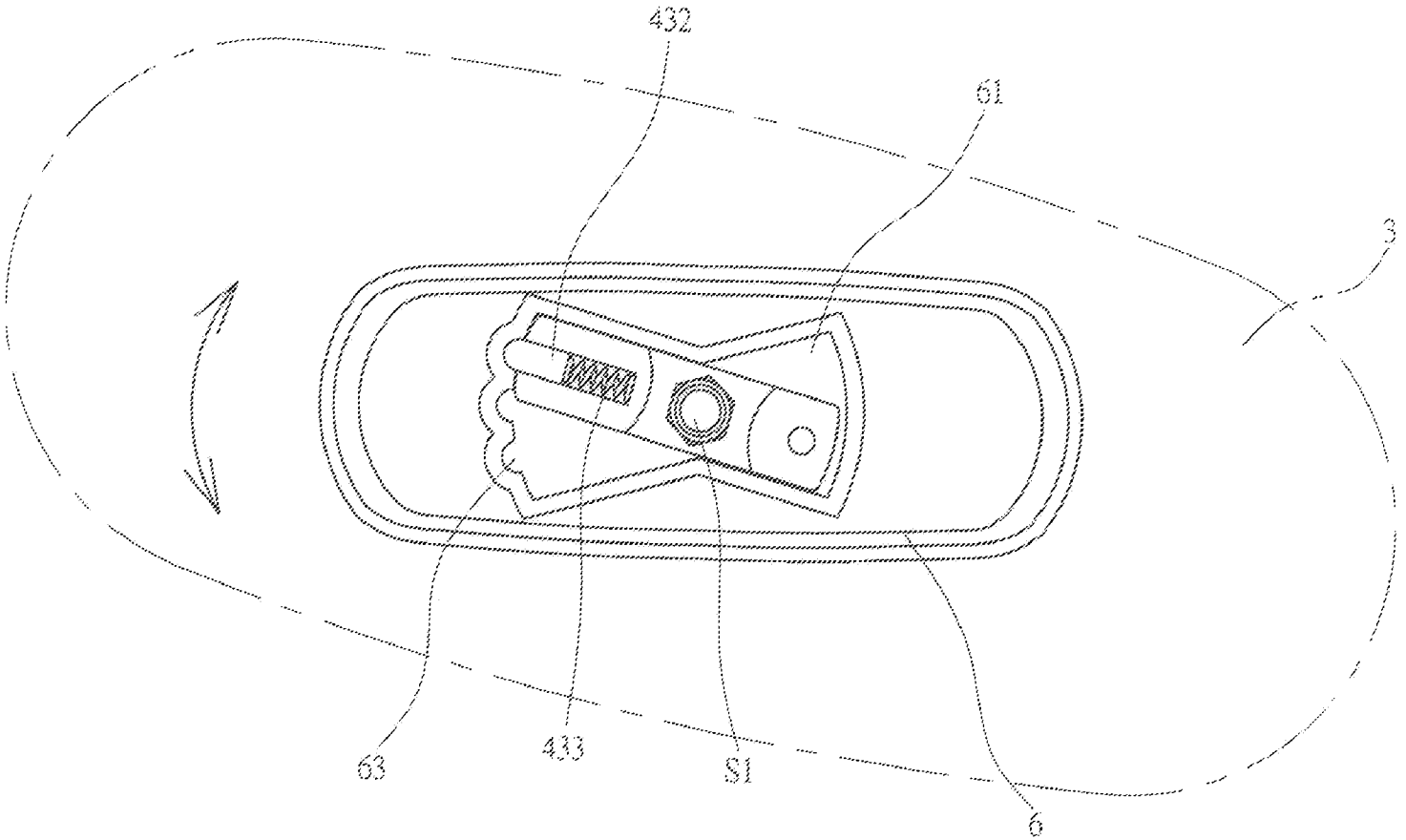
FIG. 7 is a top view showing the arm resting device of FIG. 3 turned to a different direction from the direction of FIG. 6.

Please note that the track element 5 is fixedly attached to the resting element 3 while the adjustment element 4 is fixedly attached to the connection element 6. Therefore, to shift the resting element 3 towards the front or the back of the chair, a user just slides the resting element 3 forward or backward. As shown in FIGS. 4 and 5, when the resting element 3 is slid, the track element 5 is slid as well so that the protruding rods 422 of the first piece 42, due to their flexibility, are shifted into adjacent curved notches 53 and the resting element 3 is thereby positioned at a new location. As shown in FIGS. 6 and 7, the orientation of the arm resting device can be adjusted by turning the resting element 3 to the left or right of the chair. When that happens, the track element 5 and the adjustment element 4 embedded inside the track element 4 are turned as well. Due to the resilience provided by the resilient element 433, the stick 432 is turned into an adjacent curved notch 63, thereby pointing the resting element 3 to a particular direction.

To sum up, the present invention is characterized by the two-piece adjustment element 4 where the advancement of the arm resting device is adjusted by the relative sliding movement between the first piece 42 of the adjustment element 4 and the track element 5 fixedly attached to the bottom of the resting element 3; and where the orientation of the arm resting device is adjusted by turning the second piece 43 of the adjustment element 4 within the confinement of the trough 61 of the connection element 6.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An arm resting device for a chair comprising:

a resting element;

an adjustment element having a first piece and a second piece positioned to a bottom surface of said first piece, a flexible rod being provided on said bottom surface of said first piece, a resilient stick being provided at an end of said second piece;

a track element having an elongated through slot and a plurality of first notches arranged along its length besides said through slot, said second piece of said adjustment element penetrating through said through slot while said first piece resting on said track element with said flexible rod inside one of said first notches, said track element being fixedly attached to a bottom surface of said resting element; and a connection element positioned to a bottom surface of said track element having a trough on a top surface and a plurality of second notches along an edge of said trough, said trough accommodating said second piece of said adjustment element with said resilient stick inside one of said second notches, said adjustment element fixedly attached to said connection element;

wherein said arm resting element is shifted towards the front or back of said chair by a relative sliding movement between said first piece of said adjustment element and said track element; and said arm resting element is turned by turning said second piece of said adjustment element within the confinement of said trough of said connection element.

2. The arm resting device according to claim 1, wherein said flexible rod is positioned inside an indentation along a side of said first piece.

3. The arm resting device according to claim 1, wherein said flexible rod has a rounded end.

4. The arm resting device according to claim 1, wherein at least one of said first notches is curved.

5. The arm resting device according to claim 1, wherein said trough of said connection element comprises two sectorial portions fanned out towards opposite directions.

6. The arm resting device according to claim 1, wherein a tube is provided inside said trough of said connection element.

* * * * *